US005798612A

United States Patent [19]

Dirks

[11] Patent Number: 5,798,612

[45] Date of Patent: Aug. 25, 1998

[54] METAL-HALIDE DISCHARGE LAMP FOR PHOTO-OPTICAL PURPOSES

[76] Inventor: Joachim Dirks, Lüderitzstrasse 1, D-13351 Berlin, Germany

[21] Appl. No.: 793,776

[22] PCT Filed: Oct. 10, 1995

[86] PCT No.: PCT/DE95/01398

§ 371 Date: Mar. 17, 1997

§ 102(e) Date: Mar. 17, 1997

[87] PCT Pub. No.: WO96/13851

PCT Pub. Date: May 9, 1996

[30] Foreign Application Priority Data

Oct. 26, 1994 [DE] Germany ..... 44 38 294.4

[51] Int. Cl.[6] ..... H01J 61/12

[52] U.S. Cl. ..... 313/642; 313/638; 313/639

[58] Field of Search ..... 313/638, 639, 313/641, 642

[56] References Cited

U.S. PATENT DOCUMENTS

| | | | |
|---|---|---|---|
| 3,772,557 | 11/1973 | Yoshida et al. | 313/639 |
| 5,220,237 | 6/1993 | Maseki et al. . | |
| 5,689,154 | 11/1997 | Barthelmes et al. . | |
| 5,691,601 | 11/1997 | Frey et al. . | |

FOREIGN PATENT DOCUMENTS

| | | |
|---|---|---|
| 0 459 786 A2 | 12/1991 | European Pat. Off. . |
| 2137695 | 12/1972 | France . |
| 254 270 A1 | 2/1988 | German Dem. Rep. . |
| 94 01 436 U | 5/1994 | Germany . |
| 43 27 534 A1 | 2/1995 | Germany . |
| 61-165 947 | 6/1986 | Japan . |
| A 52 031 583 | 10/1997 | Japan . |
| WO 95/05674 | 2/1995 | WIPO . |
| WO 95/20822 | 8/1995 | WIPO . |

OTHER PUBLICATIONS

Database WPI, Section Ch., Week 7716, Derwent Publications Ltd., London,GB; Class L03, AN 77-28139Y of JP.A. 52 031 583 (Tokyo Shibaura Elec Ltd), Mar. 10, 1977.

*Primary Examiner*—Nimeshkumar Patel

*Attorney, Agent, or Firm*—Frishauf, Holtz, Goodman, Langer & Chick, P.C.

[57] ABSTRACT

A metal-halide discharge lamp for photo-optical purposes contains an ionisable fill, comprising mercury, at least one noble gas, at least one halogen, aluminum (Al) and indium (In) as well as gallium (Ga) in addition. By the addition of Ga, typically in the range between 0.02 mg/cm$^3$ and 1 mg/cm$^3$, a reduction in the starting voltage is attained, while maintaining an Ra>85 at color temperatures typically between 5000 K and 11000 K.

15 Claims, 1 Drawing Sheet

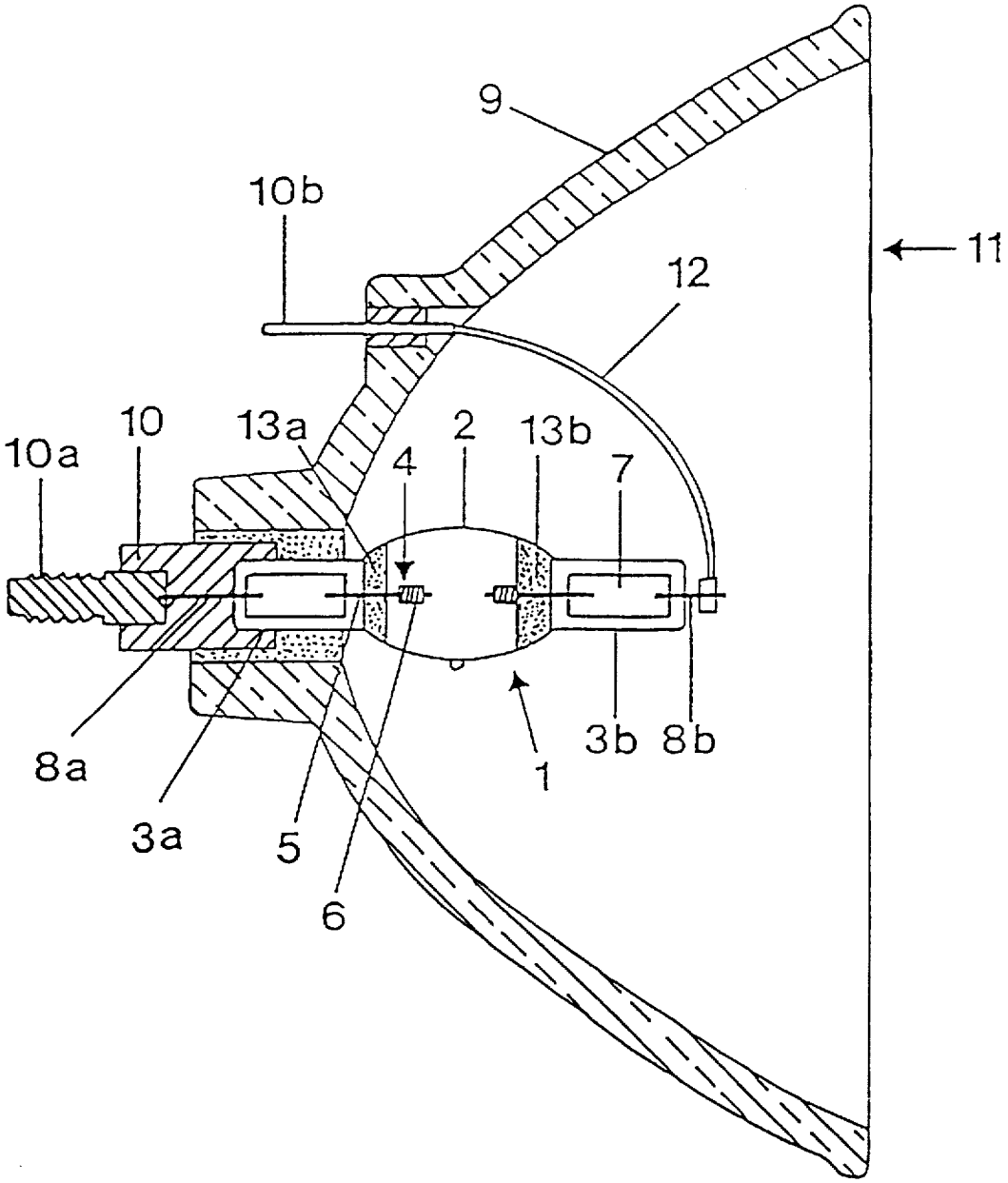
9
10b
11
12
10
13a
2
13b
10a
4
7
8a
3a
5
6
1
3b
8b

METAL-HALIDE DISCHARGE LAMP FOR PHOTO-OPTICAL PURPOSES

FIELD OF THE INVENTION

The invention relates to a metal-halide discharge lamp for photo-optical purposes, and more particularly to a lamp of the type described in U.S. Pat. No. 5,689,154, Frey et al., to which Published International Application WO 95/05674 corresponds, and U.S. Pat. No. 5,691,601, Barthelmes et al., to which Published International Application WO 95/20822 corresponds, both assigned to the assignee of the present application.

BACKGROUND

Metal-halide discharge lamps of the type described in the above publications are installed predominantly in optical reflectors or other optical-projection systems. They are used for instance in projection or optical fiber waveguide technology, and among other purposes for overhead, slide, motion-picture and video projection, as well as endoscopy and boroscopy. Accordingly, very short arcs (of a few millimeters) and maximum luminance values (on average, a few tens of kcd/cm$^2$) at color temperatures of more than 5000 K and with good to very good color reproduction (Ra>85) are required. Typical wattages are in the range of between 35 W and 600 W.

The referenced publications disclose on such lamp, with a fill that besides mercury and an inert gas also contains halogen compounds of the elements aluminum and indium. The lamps require a high starting voltages (typically about 12 kV), which is a disadvantage.

THE INVENTION

The object of the invention is to overcome the aforementioned disadvantage of high starting voltage and to create a metal-halide discharge lamp that has a color temperature of more than 5000 K—with very good color reproduction—and a relatively low starting voltage, and that accomplishes all this with the fewest possible fill components.

The discharge vessel of the metal-halide discharge lamp of the invention includes—besides the metals aluminum (Al) and indium (In)—only the element gallium (Ga) in addition, as a further metal for forming metal halides. The fill quantity of the element Ga per cm$^3$ of the vessel volume is in the range between 0.02 mg and 1 mg, and in particular is in the range between 0.03 mg and 0.2 mg. In preliminary tests, it has unexpectedly been demonstrated that by the addition of Ga only, the starting voltage of the cold lamp drops from the typical value of 12 kV to below 8 kV. The the fill also contains the usual following further components: at least one inert gas, such as argon (Ar) or xenon (Xe) as a starting gas, with a typical fill pressure in the range between about 10 kPa and 40 kPa;

mercury, to adjust the desired arc voltage, which is typically in the range between 15 mg and 30 mg for arc voltages between 60 V and 90 V; and one or more halogens, preferably iodine (I) and/or bromine (Br), for forming metal halides.

Without intending to be limited to any particular theoretical explanation, it is currently thought that there are two primary reasons for the behavior observed. First, Ga with the halogen or halogens of the fill, and particularly with iodine (I), forms compounds with a lesser electron affinity than is the case with Al and In. Second, less formation of metal halide condensate and mercury condensate on the electrodes was observed. In previous fill systems for short-arc lamps—unlike long-arc lamps—condensate formation on the electrodes is thought to be primarily responsible for elevated starting voltages. Aside from the improved starting performance in both the cold and the hot lamp, an improved reproducibility of the arc onset can be observed at the electrode tips. Possibly, the more than 10 times higher vapor pressure of the GaI, as compared with InI, also contributes to the faster development of the arc. The starting performance can essentially be varied by means of a suitable stoichiometry of the fill components Al, In and Ga.

In East German Patent 254 270, a short-arc lamp is disclosed whose complex fill is composed substantially of the elements mercury (Hg), zinc (Zn), indium, sodium (Na), lithium (Li) and halogens. This patent does mention that In can be fully or partly substituted by molar-equivalent amounts of Ga. However, this is said to be done solely to attain a good color reproduction and a low color temperature (in the range between 2500 K and 4000 K). Conversely, there is no mention of any influence of the Ga on the starting voltage. Moreover, this lamp is unsuited to the above-indicated use in optical-projection systems, since the color temperature of the entire system is as a rule lower, by about 1000 K to 2000 K, than that of the lamp without an optical system.

The color temperature can be varied by way of the quantitative ratios of the fill components Al, In and Ga. By a suitable selection of these ratios, color temperatures between 5000 K and 30000 K, and particularly between 5000 K and 15000 K and preferably between 5000 K and 11000 K can be established. In operation of the lamp with an optical reflector, the result is daylight-like or higher color temperatures. Typical mass ratios for In to Al and Ga to Al are in the range between about 1.0 and 0.5 for low color temperatures, and about 20 for high color temperatures. The fill quantity per cm$^3$ of vessel volume of the element Al is typically in the range between 0.01 mg and 2 mg, preferably between 0.02 mg and 0.2 mg. The fill quantity of the In is typically in the range between 0.03 mg/cm$^3$ and 0.5 mg/cm$^3$, preferably between 0.05 mg/cm$^3$ and 0.3 mg/cm$^3$. The fill quantity of the Ga is in the range between 0.02 mg/cm$^3$ and 1 mg/cm$^3$, and preferably between 0.03 mg/cm$^3$ and 0.2 mg/cm$^3$.

Quartz glass or a transparent ceramic material, such as $Al_2O_3$, is suitable as material for the lamp bulb. For the lamp, a discharge vessel closed on two ends, and covered on one or both ends for instance with a heating layer (such as $ZrO_2$), is especially suitable. Under some circumstances, the homogeneity of the light distribution and color distribution can be improved, in a manner known per se (see for example German utility model DE-GM 94 01 436), by frosting at least a portion of the outer wall of the bulb.

In a first embodiment, two electrodes facing one another are located inside the discharge vessel. The electrodes are each connected to a power supply lead, and these leads are extended to the outside in gas-tight fashion. The internal volume of the discharge vessel is less than about 3 cm$^3$. The electrode spacing is less than about 10 mm, and preferably is between 2 mm and 6 mm. Because of these compact dimensions, the lamp is a good approximation of a point-type light source, and it thus enables high optical efficiency of the system comprising the lamp and reflector. Typical power stages are in the range between 150 W and 200 W.

In one variant, the electrodes are located outside the discharge vessel, for instance on the outer wall of the discharge vessel. Optionally, an additional dielectric can be located between the electrodes and the outer wall of the discharge vessel. The advantage is that by this means, corrosion of the electrodes by the fill can be prevented in every case. In this way, maximum power densities in the discharge are in principle feasible.

Advantageously, the lamp is combined with a reflector to make a structural unit, as in U.S. Pat. No. 5,220,237, Maseki et al., to which European Patent Disclosure EP-A 459 786 corresponds. The lamp is mounted approximately axially in the reflector. The reflector has a dichroic coating, for example.

DRAWING

The invention will be described in further detail below in terms of several exemplary embodiments.

The sole drawing FIGURE is a schematic illustration of the lamp with its reflector.

DETAILED DESCRIPTION

In the drawing, a 170 W metal-halide discharge lamp 1, having an ellipsoid-like quartz glass discharge vessel 2, which is hermetically sealed on both ends by one pinch seal 3 each, is shown schematically. The internal volume of the discharge vessel 2 is about 0.7 $cm^3$. The electrodes 4 axially facing one another have a spacing of 5 mm. They comprise a tungsten electrode shaft 5 with a coil 6, likewise of tungsten, slipped onto it. In the region of the pinch 3, the shaft 5 is connected to external power leads 8 via a foil 7.

The lamp 1 is located approximately axially in a parabolic reflector 9; the arc that forms between the two electrodes 4 during operation is located at the focus of the paraboloid. Part of the first pinch seal 3*a* is located directly in a central bore of the reflector 9, where it is mounted in a base 10 by means of cement. The first power supply lead 8*a* is connected to a screw-type base contact 10*a*.

The second pinch seal 3*b* is oriented toward the reflector opening 11. The second power supply lead 8*b* is connected in the region of the opening 11 with a cable 12, which is extended, electrically insulated, through the wall of the reflector 9 back to a separate contact 10*b*. The outer surfaces of the ends 13 of the discharge vessel 2 are coated with $ZrO_2$ for the sake of heat concentration.

The fill contains 18 mg Hg and 20 kPa Ar as the basic gas. The discharge vessel 2 also contains the metal halides listed in Table 1 below.

By the addition of Ga, it was possible to lower the starting voltage from about 12 kV to less than 8 kv. The specific arc capacity and the arc voltage are approximately 34 W per mm of arc length, or 70 V. Table 2 shows the luminous characteristics attained.

TABLE 1

| Metal Halide Composition of the Lamp | |
|---|---|
| GaI | 0.66 mg |
| InI | 0.2 mg |
| $AlI_3$ | 0.6 mg |

TABLE 2

| Luminous Characteristics Attained with the Fill from Table 1 | |
|---|---|
| Light flux | 14400 lm |
| Light yield | 72 lm/W |
| Color temperature | 6800K |
| $R_a$ | 94 |
| $R_9$ | 69 |
| Lamp life | >1000 h |

In Table 3 below, several fill variants are listed along with the luminous characteristics associated with them.

TABLE 3

Fill Variants for the Lamp of FIG. 1 and the Luminous Characteristics Attained with Them

| Variant | Al | Al in mg | In/Al in mg/$cm^3$ | Ga/Al | Ga/In | $T_F$ in K | Ra in | eta lm/W |
|---|---|---|---|---|---|---|---|---|
| 1 | 0.15 | 0.21 | 1.3 | 0.67 | 0.52 | 5300 | 95 | 64 |
| 2 | 0.04 | 0.06 | 5.0 | 2.50 | 0.50 | 6800 | 94 | 72 |
| 3 | 0.02 | 0.03 | 10.0 | 5.00 | 0.50 | 7500 | 95 | 69 |

It is quite apparent that the color temperature $T_F$ can be varied by the purposeful choice of the quantity ratios of the main components Al, In, and Ga in the fill, in this case In/Al and Ga/Al.

I claim:

1. A metal-halide discharge lamp for photo-optical purposes, having a discharge vessel, at least two electrodes, and an ionizable fill within the discharge vessel, for generating light with a color temperature of more than 5000 K, wherein said fill consists essentially of mercury, at least one noble gas, at least one halogen, aluminum (Al), indium (In), and gallium (Ga).

2. The metal-halide discharge lamp of claim 1, characterized in that the fill quantity of the gallium (Ga) is in the range between 0.02 mg and 1 mg per $cm^3$ of the vessel volume.

3. The metal-halide discharge lamp of claim 2, characterized in that the fill quantity of the gallium (Ga) is in the range between 0.03 mg and 0.2 mg per $cm^3$ of the vessel volume.

4. The metal-halide discharge lamp of claim 1, characterized in that the fill quantity of the aluminum (Al) is in the range between 0.01 mg and 2 mg per $cm^3$ of the vessel volume.

5. The metal-halide discharge lamp of claim 4, characterized in that the fill quantity of the aluminum (Al) is in the range between 0.02 mg and 0.2 mg per $cm^3$ of the vessel volume.

6. The metal-halide discharge lamp of claim 1, characterized in that the fill quantity of the indium (In) is in the range between 0.03 mg and 0.5 mg per $cm^3$ of the vessel volume.

7. The metal-halide discharge lamp of claim 6, characterized in that the fill quantity of the indium (In) is in the range between 0.05 mg and 0.3 mg per $cm^3$ of the vessel volume.

8. The metal-halide discharge lamp of claim 1, characterized in that the mass ratio between indium (In) and aluminum (Al) is in the range between 0.5 and 20.

9. The metal-halide discharge lamp of claim 1, characterized in that the mass ratio between gallium (Ga) and aluminum (Al) is in the range between 0.1 and 10.

10. The metal-halide discharge lamp of claim 1, characterized in that the mass ratio between gallium (Ga) and indium (In) is in the range between 0.1 and 5.

11. The metal-halide discharge lamp of claim 1, characterized in that the at least one halogen comprises iodine (I) and bromine (Br), in a mass ratio between 0.5 and 10.

12. The metal-halide discharge lamp of claim 1, characterized in that inside the discharge vessel, two electrodes face one another, and with an electrode spacing of at most 10 mm.

13. The metal-halide discharge lamp of claim 12, characterized in that the electrode spacing is between 1 mm and 6 mm.

14. The metal-halide discharge lamp of claim 1, characterized in that the electrodes are located on the outer wall of the discharge vessel and, optionally, an additional dielectric is located between the electrodes and said outer wall.

15. The metal-halide discharge lamp of claim 1, characterized in that the lamp forms a structural unit with an optical reflector.

* * * * *